US007377629B2

(12) United States Patent
Kobayashi

(10) Patent No.: US 7,377,629 B2
(45) Date of Patent: May 27, 2008

(54) LIQUID DISCHARGE HEAD WITH FILTER STRUCTURE

(75) Inventor: Junichi Kobayashi, Ayase (JP)

(73) Assignee: Canon Kabushiki Kaisha, Tokyo (JP)

( * ) Notice: Subject to any disclaimer, the term of this patent is extended or adjusted under 35 U.S.C. 154(b) by 340 days.

(21) Appl. No.: 11/210,785

(22) Filed: Aug. 25, 2005

(65) Prior Publication Data

US 2006/0044353 A1 Mar. 2, 2006

(30) Foreign Application Priority Data

Aug. 30, 2004 (JP) ..... 2004-250352

(51) Int. Cl.
*B41J 2/175* (2006.01)

(52) U.S. Cl. ..... 347/93; 347/56; 347/63; 347/67

(58) Field of Classification Search ..... 347/20, 347/56, 61–65, 67, 92–94
See application file for complete search history.

(56) References Cited

U.S. PATENT DOCUMENTS 7,147,315 B2 * 12/2006 Keenan et al. ..... 347/93

FOREIGN PATENT DOCUMENTS

| | | |
|---|---|---|
| JP | 10-114070 | 5/1998 |
| JP | 2000-94700 | 4/2000 |

* cited by examiner

*Primary Examiner*—Juanita D. Stephens
(74) *Attorney, Agent, or Firm*—Fitzpatrick, Cella, Harper & Scinto

(57) ABSTRACT

The present invention can suppress penetration of dust and foreign particles into a nozzle of an ink jet recording head, and can manufacture and make functional a structure therefor in an economic manner and with high reliability. An ink discharge energy generating element which generates energy for discharging ink is formed on the surface of an Si substrate. The Si substrate comprises an ink supply port which communicates ink from the rear face side of the substrate to the front face side of the substrate. The ink supply port comprises a filter structure having a plurality of minute through-holes formed on the Si substrate.

2 Claims, 3 Drawing Sheets

LIQUID DISCHARGE HEAD WITH FILTER STRUCTURE

BACKGROUND OF THE INVENTION

1. Field of the Invention

The present invention relates to a liquid discharge head which discharges liquid used in an ink jet recording method and the like and a method of manufacturing the same, and in particular to an ink jet recording head which discharges recording liquid such as ink (hereinafter simply referred to as "ink" ) and records, and a method of manufacturing the same.

2. Related Background Art

In recent years, ink jet recording heads have become smaller and smaller while their densities have increased. There is an ink jet recording head which discharges ink in a vertical direction towards a substrate on which ink discharge energy generating elements, for generating energy to discharge ink, are formed. Regarding such an ink jet recording head, ink supply ports are generally formed so as to penetrate through the substrate. In this case, ink is supplied to the inside of the ink jet recording head from the rear face side (the face which is opposite to the face on which ink discharge energy generating elements are formed) via the ink supply port.

Ink supply ports usually have a long, flat pattern. A plurality of ink discharge nozzles are disposed along both side portions extending in a longitudinal direction of an ink supply port, and ink is supplied to each ink discharge nozzle from a common ink supply port. An Si substrate is generally used for the substrate of an ink jet recording head, and in this case, an ink supply port such as mentioned above may be formed using anisotropic etching.

One of the reliabilities sought in ink jet recording heads is the nonoccurrence of a recording operation malfunction called non-discharge (wherein ink does not come out of a desired nozzle) caused by a clogged nozzle. One of the reasons of such non-discharges is the penetration of dust or foreign particles in the nozzle, which blocks the supply of ink to the inside of a nozzle. Penetration of dust and foreign particles may occur either during the manufacturing process of the ink jet recording head or from the outside after the manufacturing of the ink jet recording head. As a countermeasure to the penetration of dust due to the latter occurrence, it is known to provide in the vicinity of the ink supply port of an ink jet recording head a filter with a mesh that is finer than the size of the nozzle, as disclosed in Japan Patent Application Laid-Open No. H10-114070 and Japan Patent Application Laid-Open No. 2000-94700.

However, further improvements regarding manufacturing cost, connection reliability between parts and the like were desired with conventional filters when the filter and the ink jet recording head are manufactured and mounted separately, such as the method described in Japan Patent Application Laid-Open No. H10-114070. Meanwhile, further improvements regarding the toughness of the filter itself and yield were desired with filters formed by using an anti-etching mask, such as the method described in Japan Patent Application Laid-Open No. 2000-94700.

SUMMARY OF THE INVENTION

The present invention was made in consideration of the above-described prior art, and can provide a liquid discharge head, and a method of manufacturing the same, which is capable of suppressing penetration of dust and foreign particles to the nozzles, and also capable of manufacturing and allowing to function in an inexpensive fashion and with high reliability.

In the liquid discharge head of the present invention, the liquid discharge head comprises a substrate with a liquid discharge energy generating element which generates energy for discharging liquid formed on its surface, wherein the substrate comprises a liquid supply port which distributes liquid from the rear face side of the substrate to the front face side of the substrate, and the liquid supply port comprises a filter structure having a plurality of minute through holes, formed on the substrate, which communicate from the rear face side of the substrate to the front face side of the substrate.

Such filter structures can be manufactured relatively inexpensively by using, for instance, dry etching of Si substrate or Si anisotropic etching, and are relatively tough since they comprise through holes formed on the substrate. The liquid supplied to the liquid discharge recording head passes through the liquid supply port, and therefore through the filter structure, which suppresses penetration of dust and foreign particles into the liquid discharge head.

According to the present invention, the filter structure is formed at the liquid supply port portion by a minute through hole formed on the substrate itself, on which a liquid discharge energy generating element and the like are formed, and therefore a relatively tough liquid discharge recording head which has a highly reliable filter structure can be provided. Thus, the liquid discharge head according to the present invention can suppress penetration of dust and foreign particles into the head stably and with high reliability, and in turn, can guarantee stable and highly reliable operation.

In addition, the filter structure according to the present invention can be made inexpensively by using a simple manufacturing process. Also, since the filter structure is built into the liquid supply port portion of the liquid discharge head, the filter structure can suppress penetration of dust and foreign particles even during wiring to the liquid discharge head and assembly of the liquid supply members, and can thereby increase yield. Furthermore, another advantage is that rigidness of the substrate as well as strength of the liquid discharge head is increased as compared to the case in which a liquid supply port is constituted by a single relatively large through hole.

BRIEF DESCRIPTION OF THE DRAWINGS

FIG. 2A is a schematic cross-sectional view along the line 2A-2A of FIG. 1, while

FIG. 4A is a schematic cross-sectional view of the ink jet recording head, while FIG. 4B is a schematic plan view of the ink jet recording head seen from the rear face side of the substrate;

DESCRIPTION OF THE PREFERRED EMBODIMENTS

Preferred embodiments will be described below to provide a detailed description of the present invention. In the following description of the embodiments, structures having identical functions are given like characters of reference, and descriptions of such structures having identical functions may be omitted.

First Embodiment

Figure 1:
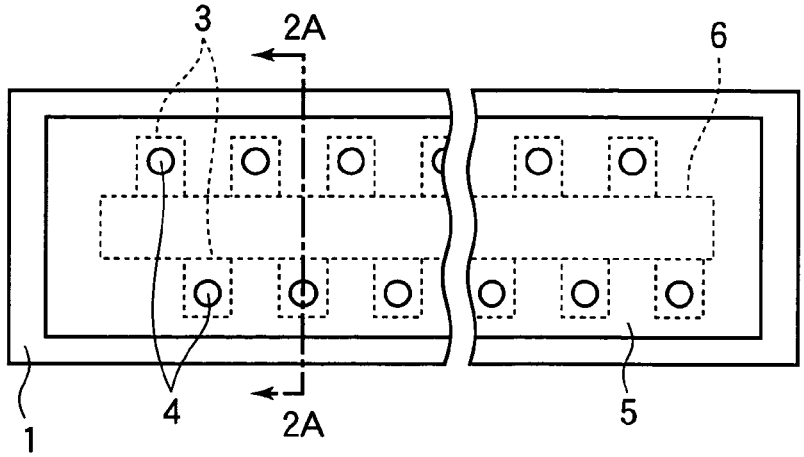
FIG. 1 is a schematic plan view of an ink jet recording head according to a first embodiment of the present invention.
Figure 2A:
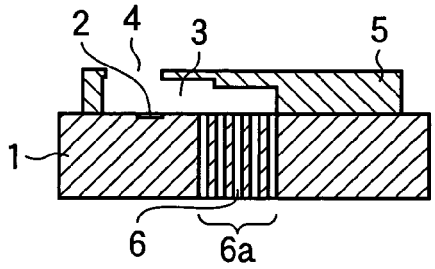
Figure 2B:
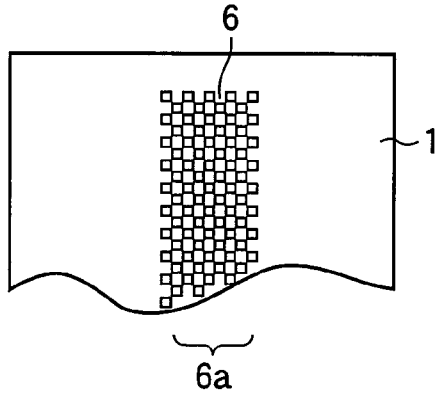
FIG. 2B is a schematic plan view of the ink jet recording head of FIG. 1 seen from the rear face side of the substrate.

FIGS. 1, 2A and 2B show schematic views of an ink jet recording head according to a first embodiment of the present invention. The ink jet recording head comprises an Si substrate 1. Ink discharge energy generating elements (liquid discharge energy generating elements) 2 which generate energy for discharging ink are formed on the Si substrate 1. In particular, the ink jet recording head according to the present embodiment is an ink jet recording head using the so-called bubble jet recording method, and uses energy generating elements for the ink discharge energy generating elements 2. While not shown, drive elements for driving the ink discharge energy generating elements 2, as well as electrical retrieving electrodes for connecting the drive elements to a control device outside of the head, are provided on the Si substrate 1.

Additionally, an ink supply port (liquid supply port) 6 is formed on the Si substrate 1 as through holes. In the present embodiment, the ink supply port 6 is comprised of a plurality of minute through holes formed over a long, flat patterned region, as shown in FIGS. 2A and 2B. In FIG. 1, the entire region over which the minute through holes are formed is shown as the ink supply port 6.

The ink discharge energy generating elements 2 are disposed in certain intervals along both side portions extending in a longitudinal direction of the ink supply port 6. The alignments of the ink discharge energy generating elements 2 on both sides are misaligned by half of an interval. In addition, disposed on the Si substrate 1 are a plurality of ink flow channels (liquid flow channels) extending from the ink supply port 6 to each ink discharge energy generating element 2, and an orifice plate 5 which forms an ink discharge port (liquid discharge port) 4 which communicates with each ink flow channel and is located above each ink discharge energy generating element 2.

In this ink jet recording head, supplying of ink from the outside of the head is performed via the ink supply port 6 from the rear face side (the side opposite to the side on which the functional elements (generally, also referred to as devices) such as ink discharge energy generating elements are formed) of the Si substrate 1. When the ink discharge energy generating elements 2 are driven when the ink flow channels 3 are filled with ink supplied via the ink supply port 6 and a meniscus is formed at the ink discharge port 4, the ink is bubbled by the heat energy generated by the ink discharge energy generating elements 2, and the accompanying pressure discharges the ink from the ink discharge port 4 on the driven ink discharge energy generating elements 2. When the ink is discharged, ink matching in quantity the discharged ink is supplied via the ink supply port 6 and fills the ink flow channel 3, thereby making it ready for discharging ink again.

In this case, the ink discharge port 6 comprises a plurality of minute through holes, and the supplied ink passes through these through holes. Therefore, large dust and foreign particles are suppressed from passing through these minute through holes, and in other words, these minute through holes constitute a filter structure 6*a*.

In order to fulfill the function of a filter, it is needless to say that it is desirable to make the hole diameters small as possible, and the holes disposed densely to enable function as a high performance filter. However, it is a finding of the present inventor that the existence of a filter in the flow path of the ink gives rise to a pressure drop (flow resistance) at the filter. Thus, the filter hinders the flow of ink, and may affect the time interval required between each ink discharge when repeatedly discharging ink, or in other words, the discharge frequency. Therefore, it is undesirable to make the hole diameters too small. This means that there exists a trade-off relationship with the improvement in filter performance described above.

Consequently, the present inventor performed an evaluation on the sizes of dust necessary to be captured by a filter, and obtained the following results. In regards to size of dust passing through the filter, it was discovered that dust with sizes equal to or less than ½ of the area of the ink discharge port 4 did not result in clogging of the ink discharge port 4 or the ink flow channel 3. The present inventor considers that this is perhaps due to the fact that dust with sizes equal to or less than ½ of the area of the ink discharge port 4 is easily discharged together with the ink. Therefore, in the present embodiment, for the configuration of a filter when the diameter of the ink discharge port 4 is 10 μm, the hole diameters are set to be 5 μm, and as shown in FIG. 2B, the holes are disposed at even intervals of 5 μm, which is equal to the hole diameter, from each other.

Next, the method of manufacturing the ink jet recording head according to the present embodiment will be described. While the description below describes the manufacturing of a single ink jet recording head on an Si substrate 1, it is needless to say that general semiconductor manufacturing technology involves multi-processing wherein a plurality of identical elements are disposed on an Si substrate and a multitude of identical products are simultaneously manufactured, and that is possible to perform similar multi-processing on the ink jet recording head of the present invention.

First, using semiconductor manufacturing technology, ink discharge energy generating elements 2 and driving elements which drive the ink discharge energy generating elements 2 are formed upon an Si substrate 1. Then, electrical retrieving electrodes for connecting the ink discharge energy generating elements 2 to an external controlling device are formed. Commonly known methods may be used for these processes, and detailed descriptions will be omitted. In any case, methods of manufacturing these parts are not restricted, and various methods may be used within the scope of the present invention.

Regarding the forming of the nozzle portion of the ink jet recording head, a removable mold material is formed using a photolithographic technique so as to occupy the region that will become an ink flow channel 3. As for the mold material, for instance, positive photoresist PMER-AR900 (Tokyo Ohka Kogyo Co., Ltd.) is used for forming to a predetermined film thickness (this film thickness is equivalent to the height of the ink flow channel 3) and pattern.

Next, the above-described removable mold material to occupy the region that will become an ink flow channel 3 is covered by a material that will become an orifice plate 5, and a photolithographic technique is used to form the orifice plate 5 which includes an ink discharge port 4. Materials which may be used for the orifice plate 5 include photosensitive epoxy resin, photosensitive acrylic resin and the like. Based on the experience of the present inventor, when selecting a material for the orifice plate 5, since the orifice plate 5 comes into constant contact with ink as a component which forms the ink jet recording head, the following must be taken into consideration.

1. Impurities from the material of the orifice plate 5 do not leach out into the ink liquid as the orifice plate 5 comes into contact with the ink.

2. A good adhesion is obtained between the orifice plate 5 and the Si substrate 1, and peeling due to aging is unlikely.

In consideration of the above, cationic polymerization compounds obtained through photoreaction is appropriate for the material of the orifice plate 5.

In addition, since the characteristics desired in the material of the orifice plate 5 depend largely on the ink liquid to be used, the material recommended by the present inventor is not always best suited, and other materials suited for the purpose may be arbitrarily selected.

Next, after the forming of the ink supply port 6 comprising a filter structure 6*a*, the above-described removable material is removed to complete the ink jet recording head. In actuality, assembly of wiring for supplying electrical signals and the like to drive the functional elements (also known as electric packaging), or assembly of structural members to supply ink to the ink supply port 6 from outside of the recording head may be required, as the case may be. In such cases, with the configuration of the present embodiment, it is possible to suppress penetration of dust, which occur during such assemble-processes, into the nozzle portion, since the filter structure 6*a* is built into the Si substrate 1 on which the functional elements of the ink jet recording head are formed, instead of attaching a filter to the ink supply port 6 upon assembly.

Various alterations can be made within the scope of the present invention to the above-described structure and method of manufacturing of the ink jet recording head, and it is absolutely permissible to use different methods of manufacturing (for instance, a method in which the members comprising a nozzle structure are independently formed, and afterwards pasted together with a substrate on which ink discharge energy generating elements are formed), as well as different material.

Next, a method of manufacturing the ink supply port 6 will be described in detail.

The ink supply port 6 can be formed by Si etching techniques from the rear face side of the Si substrate 1 on which the orifice plate 5 comprising the ink discharge port 4, and a removable mold material, are formed by the above-described process, of the ink jet recording head. Regarding the Si etching techniques, details of principles of dry etching and anisotropic etching applicable to the present embodiment are publicly known through many literatures, and therefore detailed descriptions will be omitted. In the present embodiment, the ink supply port 6 comprising a filter structure 6*a* will be formed using such techniques.

To summarize, in the case of Si dry etching, it is known to perform etching by using an ICP (Inductively Coupled Plasma) etching device and reactant gas such as $O_2$, $N_2$, $CF_4$ and $C_2F_6$. Even for structures such as the structure according to the present embodiment, it is possible to form and use a very general Si dry etching technique is possible. In other words, it is possible to form the ink supply port 6 comprising a filter structure 6*a* according to the present embodiment by forming a film of a photoresist or an inorganic material which enables obtaining of selectivity to Si as an etching mask, and patterning such masks appropriately.

When performing Si anisotropic etching, it is important that the crystal orientation of the surface of the Si substrate on which the functional elements such as the ink discharge energy generating elements are formed is <110>. In addition, when forming the ink supply port by using the dry etching technique, the crystal orientation of the Si substrate may assume any figure.

Also, when performing Si anisotropic etching, it is necessary to form a film of anti-etching mask beforehand. For such an anti-etching mask, it is generally known to use thermal oxide film ($SiO_2$) or silicon nitride film (SiN). The ink supply port 6 comprising a filter structure 6*a* according to the present embodiment may be formed by forming such films into a predetermined pattern by the photolithographic technique, and perform etching by soaking it in an alkaline solution.

As an anti-etching mask, for instance, a thermal oxide film of a thickness of approximately 1 μm may be used. In this case, while it is described above that the functional elements such as the discharge energy generating elements of the ink jet recording head may be formed using semiconductor manufacturing technology, it is known in such semiconductor manufacturing technology to perform various processing using a thermal oxide film. Therefore, it is possible to use a thermal oxide film formed through the application of such semiconductor manufacturing technology as a mask for Si anisotropic etching. In this case, a thermal oxide mask inevitably formed during the manufacturing process will be positively utilized, resulting in an advantage where a process for exclusively forming a mask for etching will be unnecessary.

According to the present embodiment described above, since the ink supply port 6 comprises a filter structure 6*a*, penetration of dust and foreign particles from the outside into the ink flow channel 3 of the ink jet recording head may be suppressed, and therefore, an ink jet recording head capable of stable and highly reliable operation can be provided. In this case, the filter structure 6*a* can be formed by a simple process during the manufacturing process of the ink jet recording head, resulting in lower manufacturing cost. In addition, since wiring from the outside and ink supply members will be assembled after the filter is built into an Si substrate 1 on which functional elements are formed and the material forming the nozzle portion is formed on the Si substrate 1, it is possible to suppress the penetration of dust and foreign particles into the nozzle portion during such assembly processes, resulting in manufacturing with high yield. Furthermore, since the filter structure 6*a* is built into the Si substrate. 1, the filter structure is relatively tough, and when compared to a structure wherein the ink supply port 6 is formed as a single large through hole, the rigidity of the Si substrate 1 as well the strength of the entire ink jet recording head can be improved.

Second Embodiment

Figure 3:
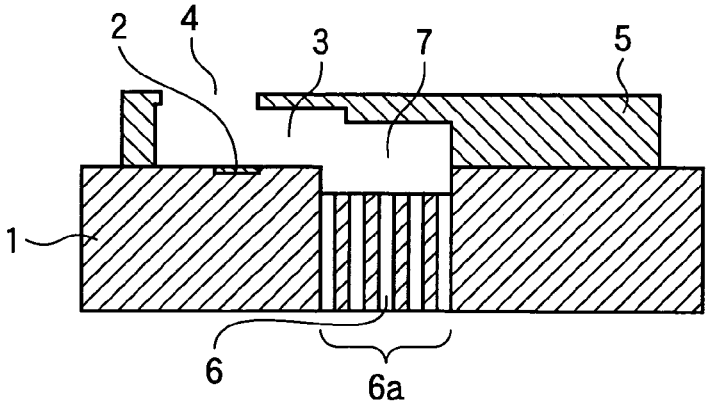
FIG. 3 is a schematic cross-sectional view of an ink jet recording head according to a second embodiment of the present invention.

FIG. 3 shows a second embodiment of the present invention. In this embodiment, a groove structure 7 is formed at the side of the ink supply port 6 which faces the inside of the head. In this example, the groove structure 7 is configured so that it commonly communicated with the plurality of through holes comprising a filter structure 6*a*, and is formed as a depressed portion covering the entire region of the ink supply port 6.

By creating such a groove structure 7, a sufficient quantity of ink to be supplied can be secured even when a large amount of ink is consumed and therefore must be supplied within a short time, or in other words, during a cycle of ink discharge, such as when there are a particularly large number of nozzles connecting to a single ink discharge port 6. For this purpose, it is desirable that the capacity of the groove structure 7 is around two times the amount of ink consumed at all nozzles within one cycle of ink discharge, and therefore must be supplied until the next cycle. However, the capacity of the groove structure 7 is not restricted to this capacity, but an appropriate capacity may be applied depending on the characteristics of the ink or discharge frequency.

Incidentally, when forming the groove structure 7, since the groove structure 7 is created on the side of the Si substrate 1 on which the part constituting the nozzle, in other words the orifice plate 5, is disposed, it is needless to day that the groove structure 7 must be formed before the orifice plate 5 is disposed on the Si substrate 1.

Third Embodiment

Figure 4A:
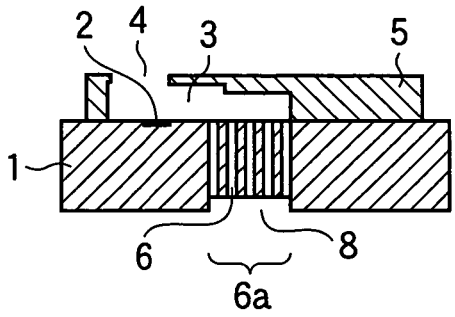
FIGS. 4A and 4B are explanatory diagrams of an ink jet recording head according to a third embodiment of the present invention.
Figure 4B:
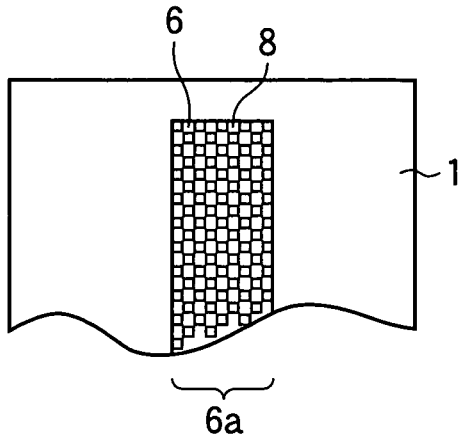

FIGS. 4A and 4B show a third embodiment of the present invention. In this embodiment, a groove structure 8 is formed on the rear face side of an Si substrate 1. In this example, the groove structure 8 is configured so that it is commonly communicated with the plurality of through holes constituting a filter structure 6*a*, and is formed as a depressed portion covering the entire region of the ink supply port 6, in the same manner as the groove structure 7 in the above-described second embodiment.

By creating such a groove structure 8, when joining members for supplying ink to the ink supply port 6 using adhesives and the like, it is possible to suppress inflow of the adhesive due to a capillary phenomenon into the inside of the through holes constituting the filter structure 6*a*, thereby achieving good adhesion. It is also possible to give an external ink supply member a structure that matches with the groove structure 8, thereby enabling easy alignment with the external ink supply member.

FIGS. 5A to 5D are schematic cross-sectional views showing an example of a method of manufacturing an ink jet recording head according to the embodiment of the present invention shown in FIGS. 4A and 4B. The method of manufacturing will be briefly described below, with a focus on the difference between the first embodiment.

Figure 5A:
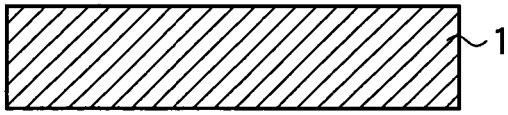
FIGS. 5A, 5B, 5C and 5D are schematic cross-sectional views showing an example of a manufacturing process of an ink jet recording head according to the present invention.

First, as shown in FIG. 5A, an Si substrate 1 for forming ink discharge energy generating elements (liquid discharge energy generating elements) 2 for generating energy to discharge ink is prepared.

Figure 5B:
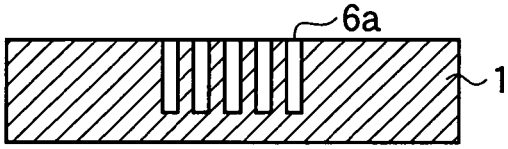

Next, as shown in FIG. 5B, a filter structure 6*a* is formed from the front face side (the side on which the ink discharge energy generating elements are formed) to the middle of the substrate. Regarding the method of forming the filter structure 6*a*, methods such as anisotropic etching, dry etching or laser may be used.

Figure 5C:
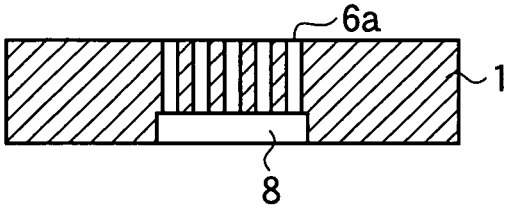
Figure 5D:
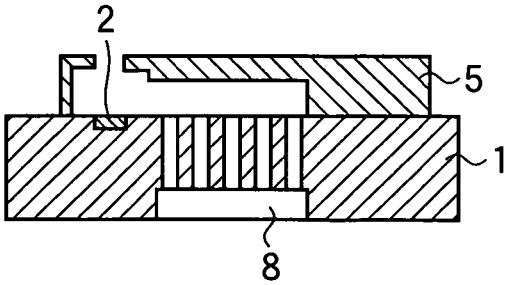

Then, as shown in FIG. 5C, the grove structure 8 is formed from the rear face side of the Si substrate 1, and is communicated with the filter structure 6*a*. Regarding the method of forming the groove structure 8, methods such as anisotropic etching, dry etching or laser may be used. Forming the filter structure 6*a* and the groove structure on the ink supply port in this sequence is desirable for securing rigidity of the substrate when performing the process of FIG. 5C.

Afterwards, ink discharge energy generating elements 2 and an orifice plate 5 are formed onto the surface of the Si substrate 1 to complete the recording head.

Fourth Embodiment

Figure 6:
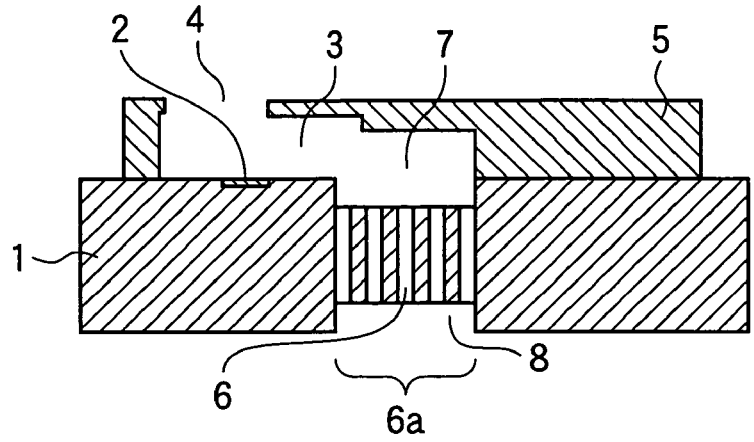
FIG. 6 is a schematic cross-sectional view of an ink jet recording head according to a fourth embodiment of the present invention.

FIG. 6 shows a fourth embodiment of the present invention. In this embodiment, groove structures 7 and 8 are respectively formed on the front and rear face sides of an Si substrate 1.

Incidentally, embodiments having groove structures on the rear face side of the substrate, as shown in FIGS. 4 and 6, are desirable since there are no risks of damaging the filter structure due to handling during later stages of manufacturing.

Other Embodiments

Figure 7:
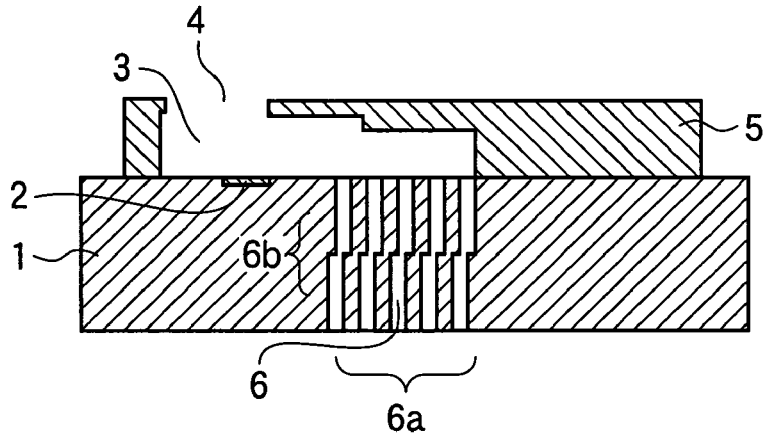
FIG. 7 is a schematic cross-sectional view of an ink jet recording head according to another embodiment of the present invention.

As another embodiment, in the configuration shown in FIG. 7, through holes constituting a filter structure 6*a* is formed so as to have a bent structure 6*b* in the middle of the direction of the depth of an Si substrate 1, instead of as straight holes extending vertically inside the Si substrate 1. By creating such a bent structure 6*b*, it is possible to make the cross-sectional area of the through holes even smaller, thereby suppressing the penetration of more minute dust and foreign particles into the head.

More specifically, in recent years, advancements in the high quality imaging of ink jet recording heads have been made, and in turn, advancements in the reduction of droplet size of the ink droplets have been made. This gives rise to cases where the ink discharge port 4 is more minute. In such cases, it is necessary to deal with more minute dust. Therefore, while it is necessary to provide the through holes constituting the filter with smaller diameters which correspond to the miniaturization of the ink discharge port 4, difficulties in forming such minute through holes by Si etching can be envisioned when simply miniaturizing the through holes. The configuration with the bent structure 6*b* enables reduction of the cross-sectional areas at the bend structure 6*b* without reducing the size of the through holes themselves which are formed by Si etching, and is therefore effective as a method of forming a filter structure 6*a* which is capable of capturing more minute dust and foreign particles in a simple and effective manner.

Through holes comprising such bent structures 6*b* may, for instance, be formed in the following manner. First, columnar holes are formed beforehand by etching from the front face side of an Si substrate 1 to the middle of the direction of the thickness of the Si substrate 1 before disposing an orifice plate 5. Then, from the back face side, holes are formed by etching at positions misaligned from the holes formed from the front face side, and the holes formed from the front and back face sides are communicated at the middle of the direction of the thickness of the Si substrate 1.

Figure 8:
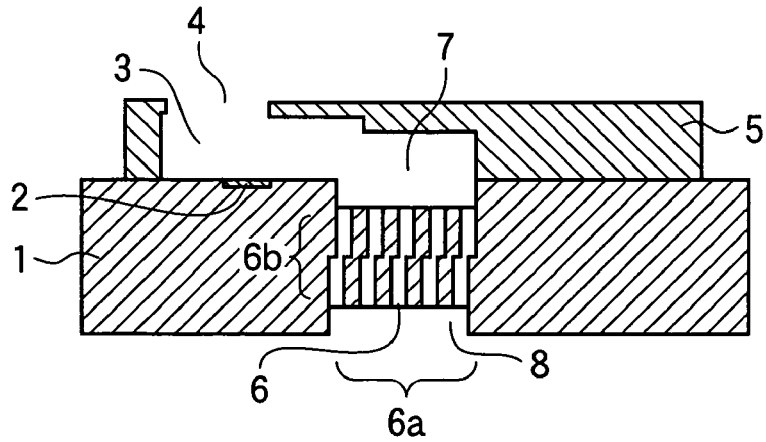
FIG. 8 is a schematic cross-sectional view of an ink jet recording head according to yet another embodiment of the present invention.

FIG. 8 shows yet another embodiment wherein an ink jet recording head with a configuration in which the groove structures 7 and 8, as well as the bent structure 6*b* are simultaneously provided.

This application claims priority from Japanese Patent Application No. 2004-250352 filed on Aug. 30, 2004, which is hereby incorporated by reference herein.

What is claimed is:

1. A liquid discharge head which discharges liquid, comprising, a substrate with a liquid discharge energy generating element which generates energy for discharging liquid formed on its surface; and an orifice plate comprising a discharge port which discharges liquid, wherein the substrate comprises a liquid supply port which distributes liquid from a rear face side of the substrate to a front face side of the substrate, the liquid supply port comprises a filter structure having a plurality of minute through-holes, formed on the substrate, which communicate from the rear face side of the substrate to the front face side of the substrate, and the through-holes constituting the filter structure are provided with at least one point having a bend structure in the middle of the direction of the thickness of the substrate.

2. A liquid discharge head which discharges liquid, comprising:

a substrate with a liquid discharge energy generating element which generates energy for discharging liquid formed on its surface; and an orifice plate comprising a discharge port which discharges liquid, wherein the substrate comprises a liquid supply port which distributes liquid from a rear face side of the substrate to a front face side of the substrate, the liquid supply port comprises a filter structure having a plurality of minute through-holes, formed on the substrate, which communicate from the rear face side of the substrate to the front face side of the substrate, and the substrate is provided with a structure which is grooved from the front face side of the substrate for the entirety of the portion on which the through-holes constituting the filter structure are disposed.

* * * * *

UNITED STATES PATENT AND TRADEMARK OFFICE

CERTIFICATE OF CORRECTION

PATENT NO. : 7,377,629 B2
APPLICATION NO. : 11/210785
DATED : May 27, 2008
INVENTOR(S) : Kobayashi It is certified that error appears in the above-identified patent and that said Letters Patent is hereby corrected as shown below:

COLUMN 1:
Line 54, “are” should read --were--.

COLUMN 5:
Line 38, “occur” should read --occurs,-- and “assemble-processes,” should read --assemble processes,--.

COLUMN 7:
Line 23, “day” should read --say--.

COLUMN 10:
Line 1, “energy generating” should read --energy-generating--.

Signed and Sealed this

Third Day of March, 2009

John Doll

JOHN DOLL
*Acting Director of the United States Patent and Trademark Office*